United States Patent [19]

Spence

[11] 4,206,710

[45] Jun. 10, 1980

[54] RAILWAY CAR CENTER PLATE FILLER ARRANGEMENT

[75] Inventor: John H. Spence, Munster, Ind.

[73] Assignee: Pullman Incorporated, Chicago, Ill.

[21] Appl. No.: 905,678

[22] Filed: May 15, 1978

[51] Int. Cl.[2] ..... B61F 1/14; B61F 5/16; B61G 7/10

[52] U.S. Cl. ..... 105/420; 105/199 C; 105/228; 213/57; 308/137

[58] Field of Search ..... 105/109 C, 228, 248, 105/404, 406 R, 416, 420; 213/57; 308/137

[56] References Cited

U.S. PATENT DOCUMENTS

| | | | |
|---|---|---|---|
| 698,058 | 4/1902 | Sage | 105/420 |
| 864,482 | 8/1907 | Neikirk | 105/228 |
| 1,161,941 | 11/1915 | Lockwood | 105/228 |
| 1,199,815 | 10/1916 | Ostrander | 213/57 X |
| 1,851,995 | 4/1932 | Wine | 105/228 |
| 2,178,034 | 10/1939 | Dorey | 105/228 |
| 2,222,480 | 11/1940 | Cottrell | 105/420 X |
| 2,244,518 | 6/1941 | Dietrichson | 213/57 |
| 2,309,024 | 1/1943 | Tesseyman et al. | 213/57 |
| 2,804,024 | 8/1957 | Boese | 105/228 |
| 2,931,319 | 4/1960 | Candlin, Jr. | 105/228 |
| 2,942,738 | 6/1960 | Blattner | 213/57 |
| 2,995,258 | 8/1961 | Lusink et al. | 213/57 |
| 3,102,643 | 9/1963 | Couch | 213/57 |
| 3,557,713 | 1/1971 | Spence et al. | 105/406 R X |
| 3,557,714 | 1/1971 | Aquino et al. | 105/406 R |
| 3,603,265 | 9/1971 | Barber | 105/228 X |
| 3,605,634 | 9/1971 | Johnson | 105/248 |
| 3,605,635 | 9/1971 | Stark | 105/248 |
| 3,703,239 | 11/1972 | Furniss | 213/57 |
| 3,797,674 | 3/1974 | Reynolds | 105/228 X |
| 4,130,068 | 12/1978 | Stark et al. | 105/420 |

*Primary Examiner*—Howard Beltran
*Attorney, Agent, or Firm*—Richard J. Myers

[57] ABSTRACT

A modular center filler and center plate may be constructed as a unit away from the car and adapted for connection to the center sill webs of a railway vehicle. The center filler has a thick bottom plate which extends beneath the center sill and has pairs of interconnected longitudinal and transverse sill reinforcing plates arranged in a double I-beam manner. The center plate has longitudinally extending attached skirts, and bevels are provided which allow the car to rock at the bevel lines. Forces transmitted through the center plate at the bevels are absorbed and distributed by the associated longitudinal plates and other bolster and center filler structural elements.

17 Claims, 6 Drawing Figures

RAILWAY CAR CENTER PLATE FILLER ARRANGEMENT

BACKGROUND OF THE INVENTION

1. Field of the Invention

This invention relates to railway vehicles and in particular to a portion of the vehicle underframe where the so-called center sill interconnects with transversely extending bolster members and where the railway vehicle body is supported upon its wheeled truck.

2. Description of the Prior Art

As it is well known in the art, a railway vehicle is supported at each end by a member called a center plate unit which comprises a center plate member attached to the body portion of the vehicle and a bowl portion attached to a bolster of the supporting truck unit. Because the center plate is a relatively small member in proportion to the vertical and horizontal forces encountered by the railway vehicle during transit and during coupling and uncoupling, extremely high stresses are produced in this area of the railway vehicle which can result in premature or excessive maintenance. For years the railroad industry has thought to eliminate permature failures caused by stress cracking at this area of the railway vehicle by a number of different constructions. Prior arrangements included center plates attached to the horizontal flanges of the sill. However, it has been found that failures with such a construction can result when the spaced side webs of the center sill and horizontally extending flanges which extend therefrom, are not correctly aligned in a horizontal plane. Consequently, when a center plate mounting plate or a so-called sole plate is attached to interconnect the spaced side flanges of the center sill and the center plate is attached, in inaccurate alignment between the center plate and the truck mounted bowl results because of the mismatched surfaces. Therefore, when the center plate is not attached to a truly flat horizontal flange connecting mounting plate, it must be either machined flat to mate with the bowl portion of the supporting truck, or, there will be no full surface-to-surface contact and, instead, only a portion of the center plate will be in a very highly stressed condition resulting in tremendous forces being generated unevenly through the center plate, center filler, draft sill and bolster connection and oftentimes resulting in premature wear and failures.

Further, as rocking of the railway vehicle occurs during transit the outboard bevels permit car body pivoting about the bevel line rather than the edge type pivoting which would occur with a conventional center plate. After a limited amount of pivoting occurs about the bevel, the car side bearings would prevent further car body pivoting.

U.S. Pat. No. 2,178,034, Dorey, attempted to overcome the problem of mismatching the center sill flanges by providing a unitary center filler and center plate unit. However, Dorey, presents serious problems in its application because it does not disclose bevels or any manner of replacing a center plate which may be damaged and thus requires complete replacement of the entire center filler unit.

The Furniss, U.S. Pat. No. 3,703,239 (1972), shows a modular center filler with a separate center plate. However, the center filler does not provide a bottom plate protruding below the side flanges of the center sill. Thus, it is impossible to machine flat the mounting plate to which the center plate is attached. In the event there is a misalignment or mismatching between the center sill components the modular unit provided in Furniss will only reproduce the inaccuracies in the existing center sill construction.

On the other hand, applicant's invention overcomes the problems of the prior art by providing a modular unit that provides a mounting surface for a center plate that can be machined in the event additional flatness requirements must be met due to inaccuracies between the side members of the center sill. With the construction shown herein, the center plate is not attached to the sill flanges, thus further minimizing problems caused by flange misalignment. Further, because of the beveled edges, and the reinforcing plates aligned with the beveled edges, the forces encountered during rocking are evenly distributed into the center sill and bolsters.

SUMMARY OF THE INVENTION

This invention pertains to a railway vehicle and in particular to that portion of the railway vehicle which forms a connection between the vehicle body and the supporting truck. To effect such a connection, a center plate and a truck mounted center plate bowl are fitted together. As is understood because of the relatively small dimensions of the center plate unit and the large horizontal and vertical forces generated by a railway vehicle, there are enormous stresses encountered at this point of connection in any railway vehicle. This invention is intended to improve the connection by providing a structure which will insure that forces generated will be evenly distributed into the body underframe.

In use, a modular or unitary center filler plate arrangement is constructed away from the center sill. This plate arrangement comprises a thick bottom plate to which are attached front and rear cover plates. Internal longitudinally extending side plates are interconnected by a pair of longitudinally extending plates that combine to provide transverse strength and form two walls of a center pin pocket. This plate arrangement forms a double box-beam structure which is fitted between the side webs of the center sill and the front and rear cover plates and welded to the inside of each side web. Additional reinforcing gusset plates are located on the outside of each side web to further distribute forces into the center sill and into the car body bolsters which extend transversely from this portion of the railway vehicle.

The bottom cover plate is welded along its entire length on both sides between the side flanges of the center sill with its bottom surface protruding below a horizontal plane of the center sill side flanges in such a fashion that it may be machined flat to provide an even surface for attachment of a center plate.

After installation of the modular center filler, a center plate may be bolted, riveted or otherwise securely attached to the bottom cover plate. The center plate disclosed herein includes skirt portions extending from the circular center plate in such a fashion as to provide a rectangular structure that may be mounted to the bottom of the associated bottom cover plate. The center plate skirts provide an enlarged contact area for evenly distributing horizontal buff and draft shear forces between the center plate and its mating bowl.

The center plate contains a pair of spaced, longitudinally extending bevels located inwardly from the webs of the center sill and in alignment with the longitudinally extending reinforcing ribs positioned on the other side of the bottom plate. With such a configuration, when the car body rocks the center plate will not pivot about its periphery but about the bevel lines, thus providing increased contact between the center plate and its supporting bowl to adequately distribute forces and reduce stresses. Forces which develop and pass through the bevel area are distributed into the bottom cover plate and further distributed to the car body bolsters with use of the longitudinally extending plates which are in general alignment with the bevels on the center plate and interconnected to transverse plates.

It is thus an object of this disclosure to show an improved center filler arrangement for rigidifying that area of the railway vehicle where a connection is made between the vehicle's body and the supporting truck. By providing an improved center filler, forces generated at this point are evenly distributed into the center sill and into the transversely extending car body bolsters in such a fashion that they are evenly distributed thus reducing stresses and lengthening the life of the car.

These and other objects of the invention will become apparent to those having ordinary skill in the art with reference to the following description and appended claims.

DETAILED DESCRIPTION

Figure 1:
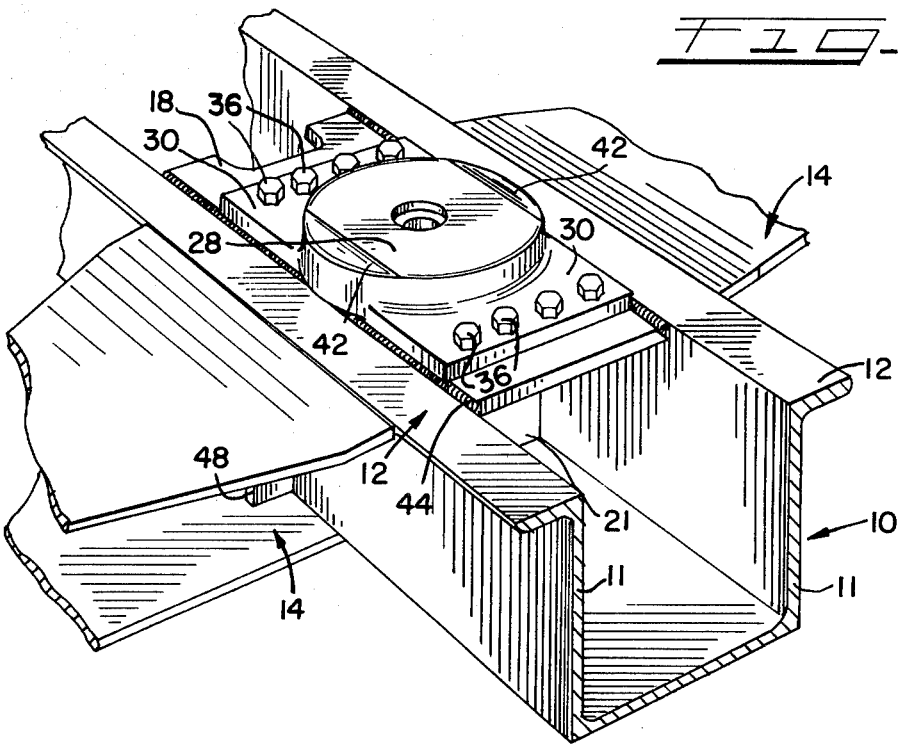
FIG. 1 is an inverted isometric view of a portion of the bolster-draft sill area with the center filler disclosed herein.

Referring now to the drawings and in particular to FIG. 1, there is shown an inverted view of the underside of that portion of the railway vehicle which forms a connection between the supporting truck and the car body. Specifically, the underframe generally includes a longitudinally extending center sill or a stub sill 10 which generally has spaced side webs 11 with horizontally extending flanges 12. Securely attached to the sill 10 at each end of the railway vehicle are transversely extending body bolsters 14. Body bolsters 14 are structural beams generally constructed of welded plates and intended to provide horizontal support to the railway car body.

Figure 3:
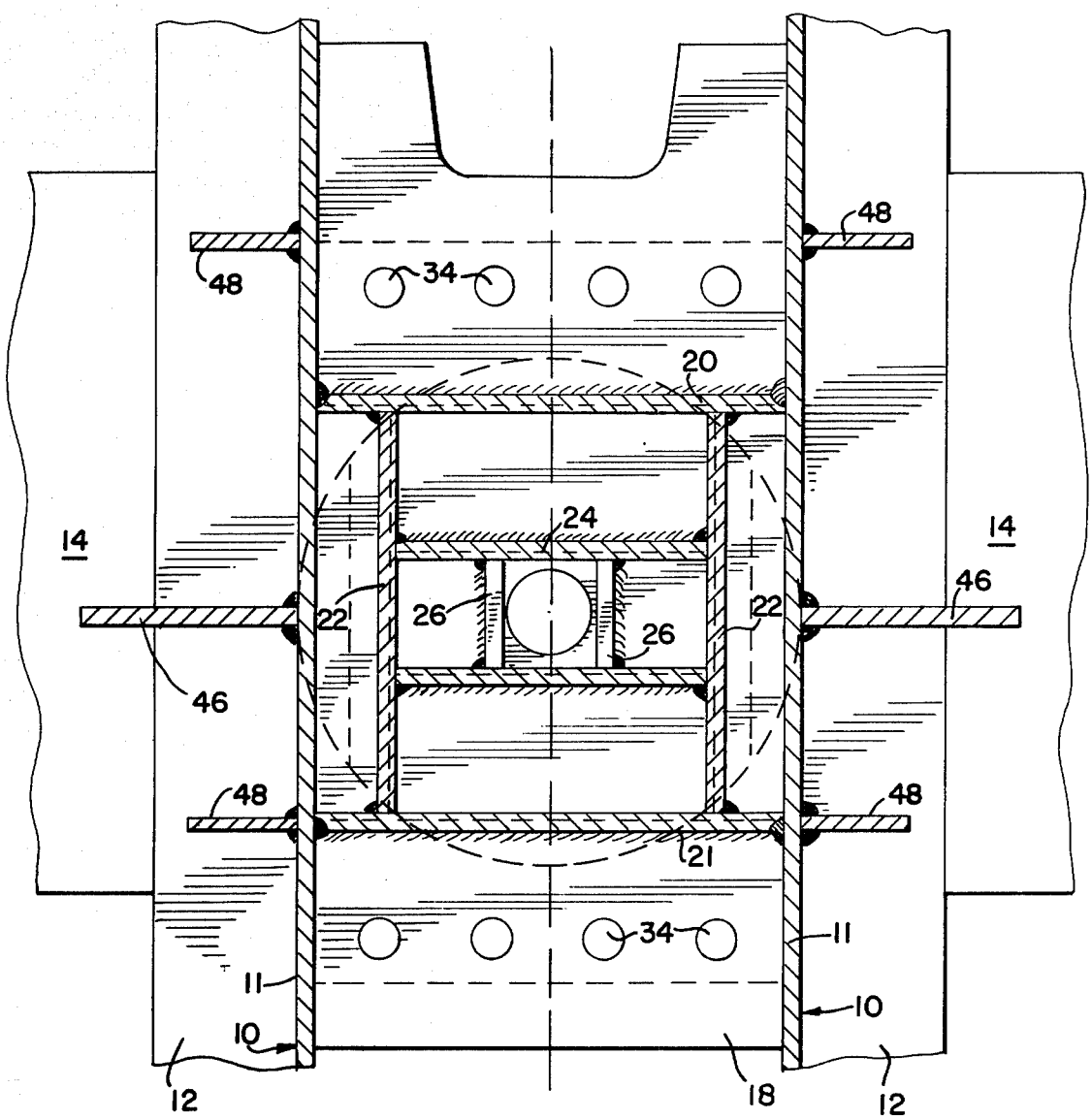
FIG. 3 is a sectional view taken generally along lines 3—3 of FIG. 2.
Figure 4:
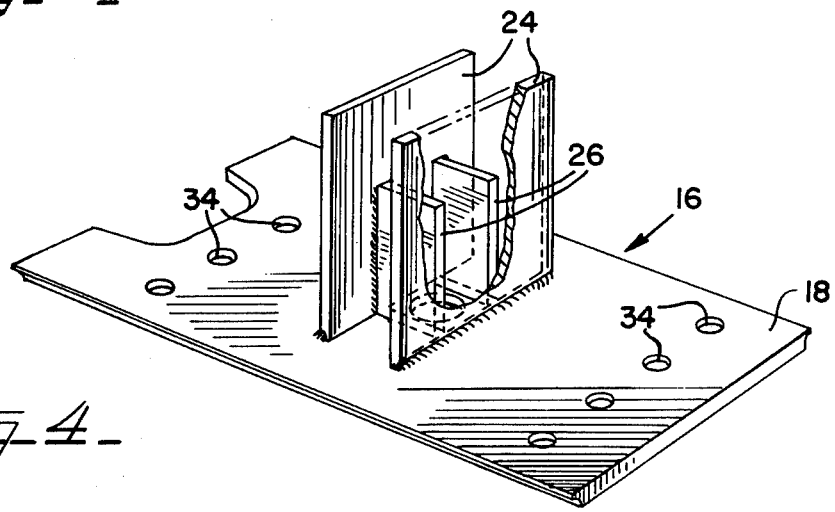
FIG. 4 is an isometric view of a portion of the center filler.
Figures 5, 6:
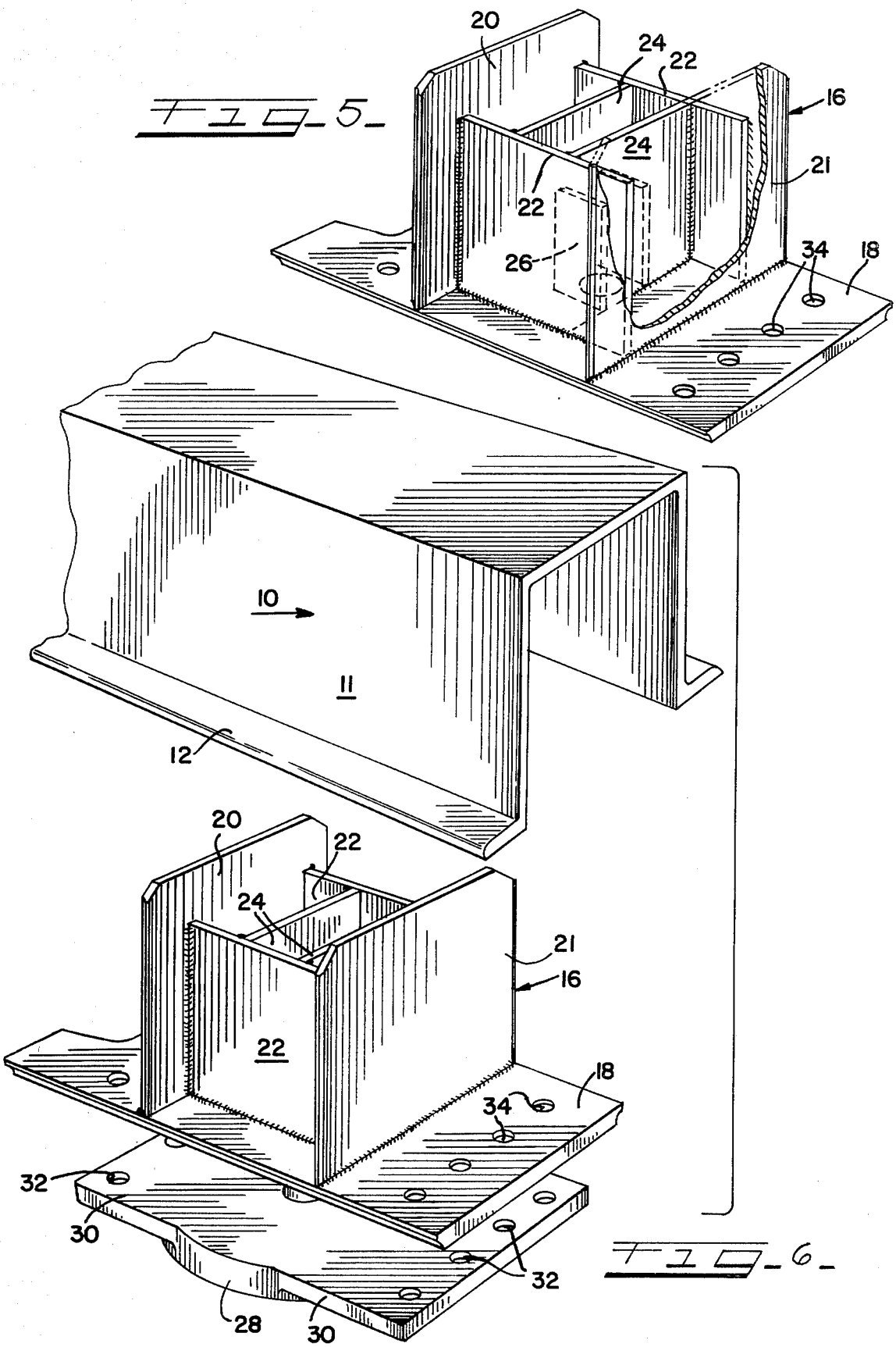
FIG. 5 is an isometric view of the center filler having a portion of a transverse cover plate away to show details thereof.
FIG. 6 is an exploded isometric view of the structure of FIG. 1.

In order to adequately rigidify the point of connection between the center sill 10 and the body bolsters 14 a so-called center filler 16 is provided. As shown in FIGS. 5 and 6, the center filler provides a number of plates constructed in such a manner to evenly distribute forces at this connection point to reduce wear and prevent premature failures. As shown in FIGS. 5 and 6, the center filler arrangement includes a bottom cover plate 18. Front and rear cover plates 20, 21, respectively, extend upwardly from the bottom cover plate 18 and are securely welded thereto. Longitudinal connector plates 22 are spaced inwardly of each edge of the bottom cover plate 18 and extend continuously between the cover plates 20, 21, and are securely welded thereto. Transverse connector plates 24 interconnect the mid-portions of the longitudinal plates 22 and also combine with the pocket plates 26 to provide a so-called center pin pocket. Plates 26 also rigidify the transverse plates 24 to which they are connected. Thus, it is noticed that with the welded plate arrangement described, the lengthy plates which extend transversely and longitudinally are rigidified by plates that are connected thereto and which act as reinforcing gussets for each plate to which they are connected. This plate arrangement of the center filler 16 provides a double I-beam or box section reinforcing structure wherein the plates are arranged to be mutually reinforced. As shown in FIG. 3, longitudinal plates 22 combine with transverse plates 24 to form one box beam. Also, plates 24 and 26 form a second box beam.

The center filler arrangement is constructed as a modular unit such as that shown in FIG. 5 away from the railway vehicle and is subsequently attached to the railway vehicle as shown in FIG. 1. To provide for such attachment, the bottom cover plate 18 has a contoured edge at each side for replacement of a weld along its length to securely attach the bottom cover plate 18 to the sill 10. Further, after the center filler 16 is positioned into the center sill the front and rear cover plates 20, 21, are also welded to the inside of the side webs 11 as shown in FIG. 3.

When the center filler 16 is securely positioned, it is noticed that the bottom cover plate 18 (FIG. 2) has a bottom surface extending below the bottom surface of the center sill flanges 12. Thus, in the event there is a misalignment or other dimensional problem which prevents the bottom cover plate from being completely horizontal or flat, it may be machined into a flat condition without machining the bottom flanges 12 which would be undesirable and create a structural irregularity in the center sill.

After the center filler 16 is positioned, center plate 28 is firmly attached. The center plate is attached with the use of skirts 30 which extend from the round portion of the center plate and contain openings 32 which align with associated openings 34 of the bottom cover plate 18. After being positioned, the center plate 28 is securely attached with the use of high strength bolts or rivets 36.

Figure 2:
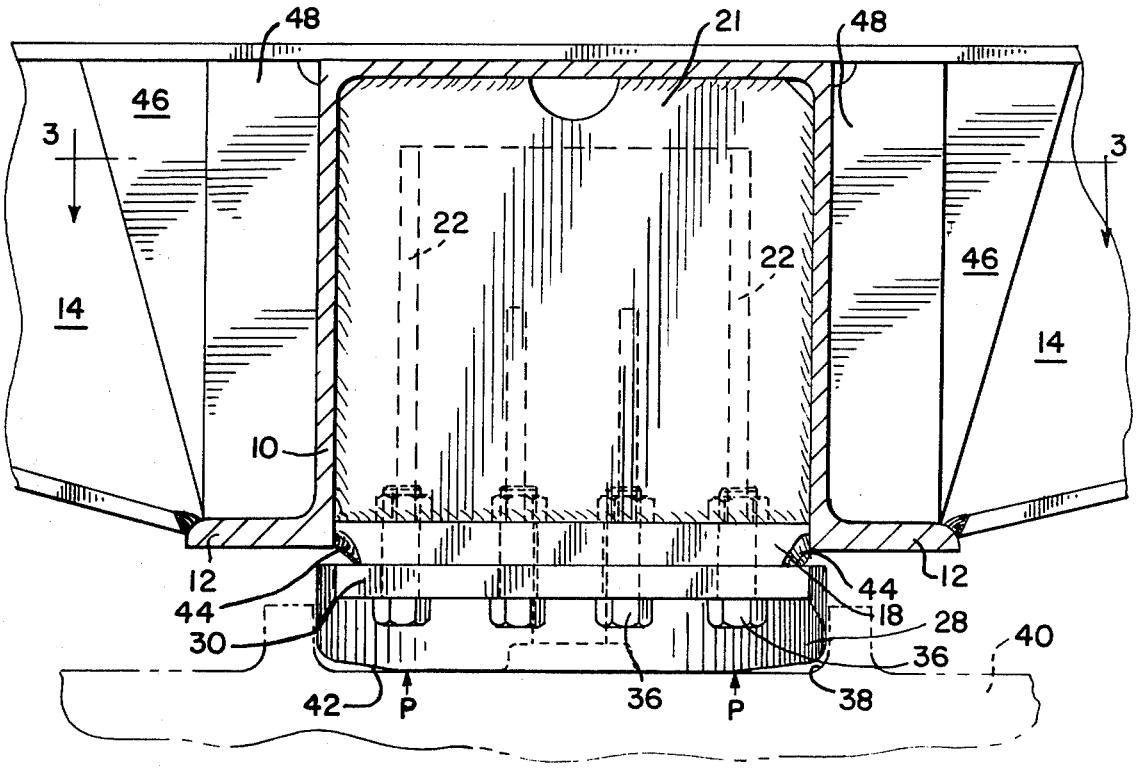
FIG. 2 is a transverse cross-sectional view of the structure of FIG. 1.

As shown in FIG. 2, the center plate 28 rests within an associated center plate bowl 38 which is an integral part of a so-called truck bolster 40. Thus, as the railway vehicle moves relative rotation is permitted between the supporting bowl 38 and its mating center plate 28.

As shown in FIGS. 1 and 2, the center plate 28 includes an inclined or bevel portion 2 at each transverse edge. This bevel provides a pivot line P (FIG. 2) about which the center plate pivots in the event lateral forces subject the car body to pivoting as oftentimes occurs during transit. With these bevels 42, the center plate is prevented from pivoting about its outer edge or periphery. Such pivoting is undesirable because of the small size of the peripheral contact point which produces high stresses and distributes forces directly into a small portion of the sill side web 11 and flange 12. With this design line contact is maintained between the center plate 28 and its supporting bowls 38. With such an arrangement, the vertical forces are transmitted directly through point P (FIG. 2) into the bottom cover plate 18 and into the longitudinally extending plates 22. Plates 22 are aligned directly above the bevel line or pivot points P and thus receive vertical forces which occur upon a car rocking in such a manner as to distribute the forces into the front and rear cover plates 20, 21, and into the laterally extending plates 24 for efficient distribution into the center sill 10 and body bolsters 14.

Horizontal forces are also more evenly distributed with the arrangement shown herein. For example, high shear forces are oftentimes encountered between the center plate 28 and its supporting bowl 38 during coupling and uncoupling and in particular from starting forces when a completed train has been made up and begins its initial movement. The horizontal forces, are inertial forces created between the supporting truck which is stationary and the car body which begins to move from coupler forces and thus creates high horizontal shear stress conditions on the center plate. With the arrangement shown herein, the forces applied to the center plate 28 are distributed through its enlarged skirts 30 into the bottom cover plate 18 and then into the center sill 10. The enlongated welds 44 of bottom cover plate 18 provide an enlarged area of contact for further reducing stresses and more evenly distributing the horizontal forces into the center sill.

Gusset plates 46, 48 are attached to the center sill web to further assist in distributing both horizontal and vertical forces transmitted through the center plate 28 into the center filler 16 and then outward into the car body bolsters.

The foregoing description and drawings merely explain and illustrate the invention and the invention is not limited thereto, except insofar as the appended claims are so limited, as those who are skilled in the art and have the disclosure before them will be able to make modifications and variations therein without departing from the scope of the invention.

What is claimed is:

1. A center plate reinforcing and mounting arrangement for railway vehicles having at each end a longitudinally extending sill having spaced side walls and having body bolsters attached and extending outwardly from said sill, the improvement comprising:

a modular center filler;

said center filler comprising a bottom cover plate, front and rear cover plates;

said center filler also having pairs of rigidifying means positioned between said front and rear cover plates;

said pairs of rigidifying means including longitudinal means attached to the bottom cover plate and to the front and rear cover plate;

said pairs of rigidifying means also including transverse means attached to the bottom cover plate and to the longitudinal means and forming a reinforcing gusset box-beam means within the center filler;

center plate means including skirt means;

means for attaching said center plate skirt means solely to said bottom cover plate; and means for attaching said center filler to said sill for transmitting forces and rigidifying the car at the junction of said sill and said bolster.

2. The center filler of claim 1 wherein said bottom cover plate includes:

means located beneath said sill and disposed in a horizontal plane for attachment to the center plate means;

said bottom cover plate having a length extending beyond the skirt means of the center plate means.

3. The center filler of claim 1 wherein said center plate includes:

bevel means;

said bevel means providing a pivot line on each side of the center plate;

said longitudinal means of the center filler including means disposed generally above and in alignment with said pivot line for distribution of forces from the center plate to the car body bolster.

4. The center filler of claim 1, and:

gusset means located outboard of the center filler having means attached to said sill.

5. The invention of claim 1 wherein said skirt portion of the center plate means provides:

a generally rectangular, enlarged bearing surface located within the vertical webs of the sill.

6. A center plate reinforcing and mounting arrangement for railway vehicles having at each end a longitudinally extending sill having spaced sidewalls and having body bolsters attached and extending outwardly from said sill, the improvement comprising:

a modular center filler;

said center filler comprising a bottom cover plate, front and rear cover plates;

said center filler also having a first pair of vertically extending plates attached to said bottom cover plate and to said front and rear cover plates and spaced inwardly from said sidewalls of said sill and a second pair of vertically extending plates extending between said vertically extending plates;

means for attaching said center filler to said sill;

center plate means including bevel means providing a pivot line along each side thereof; and means for attaching said center plate means to said bottom cover plate with said vertically extending plates generally in alignment with said pivot lines of said center plate means for distribution of forces from said center plate to said car body bolster.

7. The center filler of claim 6, wherein said front and rear cover plates are attached to said sidewalls of said sill, thereby to distribute forces in the areas of said pivot lines through said vertically extending plates and said front and rear cover plates to said sill.

8. An arrangement for mounting a center plate to a railway vehicle having at each end a longitudinally extending center sill having spaced sidewalls and having body bolsters attached to and extending outwardly from said sill, comprising:

modular center filler means mountable within said spaced side walls adjacent said body bolsters including a bottom cover plate means and longitudinally spaced front and rear cover plate means said center filler means including box-beam reinforcement means positioned within and connected to said bottom, front, and rear cover plate means, and spaced inwardly of said spaced sidewalls, said box-beam reinforcement means including generally longitudinally reinforcement means and generally transverse reinforcement means extending between said longitudinal reinforcement means, and said bottom cover plate means being adapted to receive said center plate.

9. The invention in accordance with claim 8, wherein said center filler means is mountable within said spaced sidewalls of said center sill with a portion of said bottom cover plate means extending below the bottom of said sidewalls.

10. The invention in accordance with claim 8, wherein said center plate is mounted solely to said bottom cover plate means.

11. The invention in accordance with claim 8, wherein said box-beam reinforcement means include pocket plate means affixed to and extending between said transverse reinforcement means.

12. The invention in accordance with claim 11, wherein said transverse reinforcement means and said pocket plate means define a center pin pocket means.

13. The invention in accordance with claim 8, and said center plate including bevel means, said bevel means providing a pivot line on each side of the center plate.

14. The invention in accordance with claim 13, and said longitudinal reinforcement means including means disposed generally above and in alignment with said pivot line.

15. An arrangement for mounting a center plate to a railway vehicle having at each end a longitudinally extending center sill portion having spaced sidewalls and having body bolsters attached to and extending outwardly therefrom, comprising:

modular center filler means mountable within said spaced sidewalls adjacent said body bolsters including a bottom cover plate means and longitudinally spaced front and rear vertical cover plate means, said center filler means including vertically extending box section reinforcement attached to said bottom, front and rear vertical cover plate means and said box section reinforcement being spaced inwardly from said sidewalls of said sill portion, and said bottom cover plate means being adapted to solely receive said center plate.

16. The invention in accordance with claim 15, and said center plate including bevel means said bevel means providing a pivot line on each side of the center plate, said pivot lines being in general vertical alignment with outboard portions of said box section reinforcement.

17. The invention in accordance with claim 15, and said bottom cover plate means extends below the bottom of said sidewalls.

* * * * *